US008711135B2

(12) United States Patent
Lin et al.

(10) Patent No.: US 8,711,135 B2
(45) Date of Patent: Apr. 29, 2014

(54) DRIVING SYSTEM OF DISPLAY PANEL HAVING A CIRCUIT OF A VOLTAGE GENERATOR AND DRIVING METHOD THEREOF

(75) Inventors: Yu-Ting Lin, Tainan (TW); Hung-Chun Li, Taoyuan County (TW); Shin-Yuan Peng, Taoyuan County (TW); Chun-Chieh Wang, Chiayl County (TW)

(73) Assignee: Chunghwa Picture Tubes, Ltd., Padeh, Taoyuan (TW)

( * ) Notice: Subject to any disclaimer, the term of this patent is extended or adjusted under 35 U.S.C. 154(b) by 277 days.

(21) Appl. No.: 13/300,175

(22) Filed: Nov. 18, 2011

(65) Prior Publication Data

US 2012/0299895 A1 Nov. 29, 2012

(30) Foreign Application Priority Data

May 27, 2011 (TW) ..... 100118631 A

(51) Int. Cl.
*G09G 5/00* (2006.01)

(52) U.S. Cl.
USPC ..... 345/211; 345/87

(58) Field of Classification Search
USPC ..... 345/204, 211, 212, 87, 94, 103
See application file for complete search history.

(56) References Cited

U.S. PATENT DOCUMENTS

| | | | | |
|---|---|---|---|---|
| 6,366,292 | B1 * | 4/2002 | Allen | 345/611 |
| 6,791,515 | B2 * | 9/2004 | Kawahaea et al. | 345/63 |
| 6,906,704 | B2 * | 6/2005 | Matsutani et al. | 345/204 |
| 2005/0104970 | A1 * | 5/2005 | Shiraki et al. | 348/208.99 |
| 2008/0001891 | A1 | 1/2008 | Kim et al. | |
| 2009/0244109 | A1 * | 10/2009 | Chen et al. | 345/690 |

FOREIGN PATENT DOCUMENTS

| | | |
|---|---|---|
| TW | 200844940 | 11/2008 |

* cited by examiner

*Primary Examiner* — Chanh Nguyen
*Assistant Examiner* — Ram Mistry
(74) *Attorney, Agent, or Firm* — Muncy, Geissler, Olds & Lowe, P.C.

(57) ABSTRACT

A driving system of a display panel and a driving method thereof are provided, in which the display panel includes a plurality of pixel units, and the driving system includes a timing controller and a voltage generator. The timing controller is used for detecting data values of the pixel units, and calculating difference values between the data values of every two pixel units, in which the calculated pixel units are in successive rows. The timing controller obtains an aggregation value of absolute values of the difference values, and then provides a related control signal to the voltage generator according to whether the aggregation value reaches a threshold value. The voltage generator provides a common voltage or provides a compensation voltage to a common electrode according to content of the control signal.

10 Claims, 7 Drawing Sheets

DRIVING SYSTEM OF DISPLAY PANEL HAVING A CIRCUIT OF A VOLTAGE GENERATOR AND DRIVING METHOD THEREOF

CROSS-REFERENCE TO RELATED APPLICATION

This application claims the benefit of Taiwan Patent Application No. 100118631 filed on May 27, 2011, which is hereby incorporated by reference for all purposes as if fully set forth herein.

BACKGROUND OF THE INVENTION

1. Field of the Invention

The present invention relates to a driving system of a display panel and a driving method thereof, and more particularly to a driving system of a display panel for compensating for a common voltage of a common electrode and a driving method thereof.

2. Related Art

In the prior art, a common voltage on a common electrode of a display panel is not stable due to an effect of source line capacitance coupling, so voltage jitter occurs accordingly, thereby further generating a horizontal crosstalk phenomenon. Therefore, the manufacturer designs a feedback compensation circuit on the display panel, so as to compensate for the influences on the common electrode by the source line coupling, so that the coupling amount is reduced after the common electrode is compensated for, thereby alleviating the problem of horizontal crosstalk.

However, when the display panel operates, the feedback compensation circuit is also in continuous operation, that is, the common electrode may be continuously compensated for. However, since the compensation of the feedback compensation circuit is not required for the presentation of all picture data, the feedback compensation circuit is in a useless power consumption state most of the time, thereby causing unnecessary energy waste and increasing the power consumption of the display panel, so it is not economically efficient as the operation efficiency and the element service life of the display panel are compared with the actual energy consumption, and meanwhile, unnecessary power consumption cost is increased.

SUMMARY OF THE INVENTION

The present invention is a driving system of a display panel for detecting compensation timing to activate a compensation mechanism and a driving method thereof.

In order to solve the problem, the present invention provides a driving system of a display panel, in which the display panel comprises a plurality of pixel units, and the driving system comprises a timing controller and a voltage generator. The timing controller is connected to the display panel and comprises a detection unit and an operation unit. The detection unit detects a plurality of data values of the pixel units, and the operation unit is used for calculating difference values between the data values of two adjacent pixel units in successive rows, aggregating absolute values of the difference values to obtain an aggregation value, comparing the aggregation value with a threshold value, and outputting a control signal according to a comparison result. The voltage generator is connected to the timing controller and a common electrode of the display panel. The voltage generator may switch an operation mode according to content of the control signal, so as to forward a common voltage or a compensation voltage to the common electrode of the display panel.

In order to solve the foregoing problem, the present invention provides a driving method of a display panel, in which the display panel comprises a plurality of pixel units. The driving method comprises: detecting a plurality of data values of the pixel units, calculating difference values between the data values of every two adjacent pixel units in successive rows, comparing an aggregation value with a threshold value, and determining to provide a common voltage or a compensation voltage to a common voltage of the pixel units according to a comparison result.

The features of the present invention lie in that, during an operation period of picture presentation, the timing controller may control the compensation timing of the common electrode according to the change of the data values of the picture, and activates a compensation switch only when a horizontal crosstalk problem occurs, so as to reduce the actual power consumption of a liquid crystal display when presenting an image picture and improve the image quality. Therefore, the required electricity and power consumption is lower than the consumption in the prior art, thereby effectively reducing the power consumption of the display panel, prolonging the element service life and reducing the actual energy loss, so unnecessary power loss cost is avoided.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
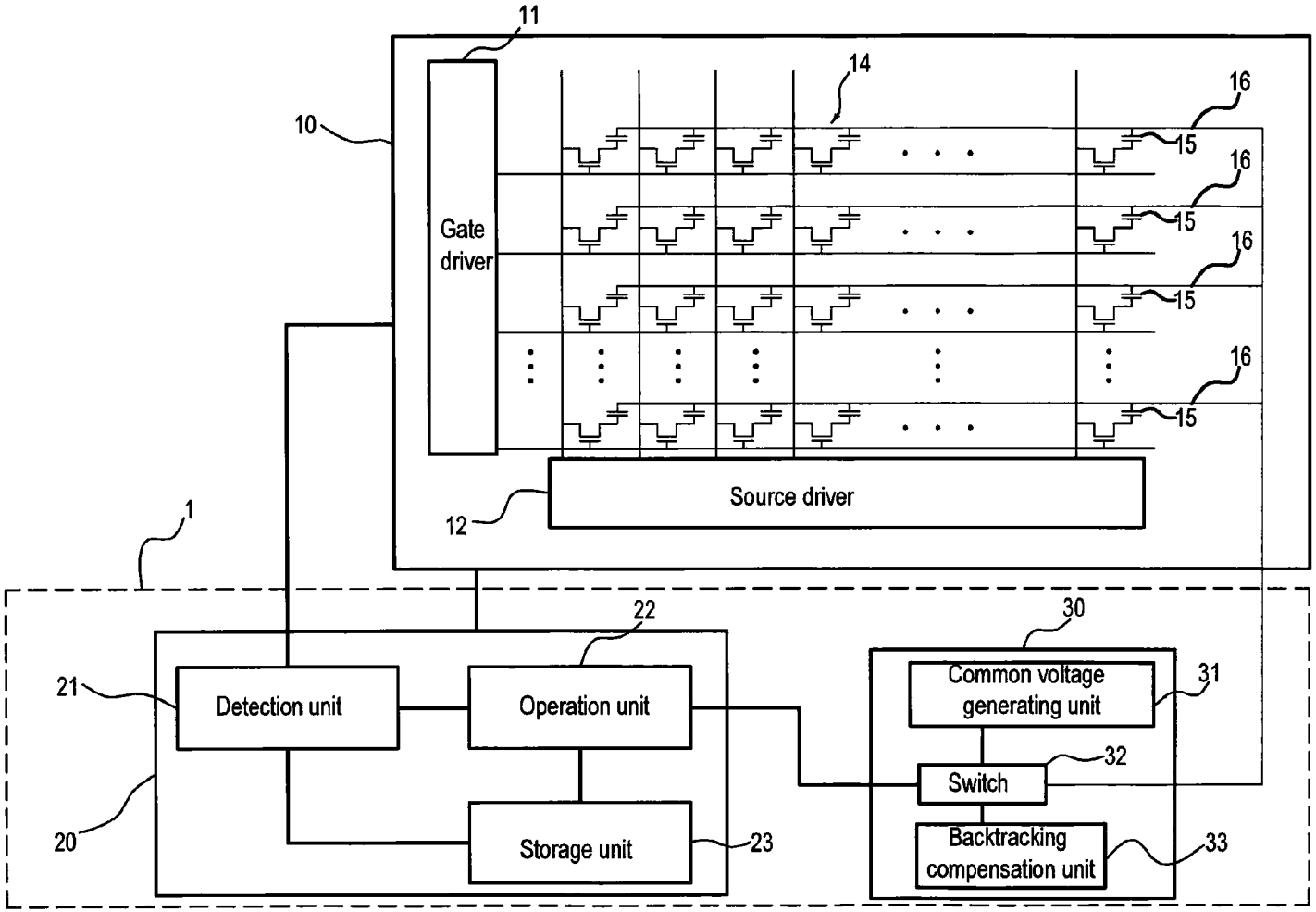
FIG. 1 is a schematic architecture view of a system according to an embodiment of the present invention.

The preferred embodiments of the present invention are described in detail below with reference to the accompanying drawings. FIG. 1 is a schematic architecture view of a system according to an embodiment of the present invention. Referring to FIG. 1, a driving system 1 is applied in a display panel 10, and includes a timing controller 20 and a voltage generator 30.

The timing controller 20 is connected to the display panel 10, and transmits obtained frame data (provided by a system apparatus or a picture providing device) to the display panel 10. A source driver 12 may convert the frame data into pixel data written into a pixel unit 14. A gate driver 11 is controlled by the timing controller 20 to send a reference operation signal, and the reference operation signal may be gradually transmitted to the gate lines, so as to activate a semiconductor channel layer of a thin film transistor for controlling charging timing of the pixel unit 14 connected to the gate lines, so that the pixel data is transmitted to a drain through the activated semiconductor layer from the sources connected to the source driver 12, and then, the pixel unit 14 is charged. The pixel unit 14 is configured in a two-dimensional array and the data value written into each pixel unit 14 is not always the same.

A detection unit 21 and an operation unit 22 are embedded in the timing controller 20, in which the detection unit 21 is used for detecting the data values stored in the pixel units 14, and the data values may be pixel data or may further be sub-pixel data. The operation unit 22 may calculate difference values between the data values obtained by the detection unit 21, and during the calculation, the rows of the used pixel units 14 are in succession and the positions thereof are adjacent. For example, the operation unit 22 may calculate a difference value between the data values included in the ith pixel unit in the nth row and the ith pixel unit in the (n+1)th row. In this way, the operation unit 22 may calculate the difference of the data values of all the pixel units 14 two rows in succession and adjacent to each other, and obtain absolute values of all the difference values, and finally aggregate the absolute values to form an aggregation value.

The operation unit 22 may compare the aggregation value with a threshold value, and send control signals with different content according to a comparison result.

A common voltage generating unit 31, a backtracking compensation unit 33 and a switch 32 are embedded in the voltage generator 30. An output end of the voltage generator 30 is electrically connected to a common electrode 15 of the display panel 10 through a common voltage line 16.

The common voltage generating unit 31 is used for providing a common voltage, the backtracking compensation unit 33 is used for providing a backtracking voltage, and the switch 32 is connected to the timing controller 20, the common electrode 15 of the display panel 10, the common voltage generating unit 31 and the backtracking compensation unit 33. When the switch 32 obtains the control signal, the switch may switch to a corresponding operation mode according to the content of the control signal. For example, after the display panel 10 presents any picture data or sets a frame, if the aggregation value calculated by the operation unit 22 is smaller than the threshold value (it is assumed that the threshold value is preset in the operation unit 22) corresponding to the display panel 10, the operation unit 22 may send a control signal having a trigger message. The control signal at a low signal level is taken as an example. Once the switch 32 obtains the control signal at the low signal level, the switch 32 integrates the common voltage with the backtracking voltage to form a compensation voltage, and transmits the compensation voltage to the common electrode 15. The timing of transmitting the control signal by the operation unit 22 may be before next picture data or a next frame of the operation unit 22, or also before the pixel units 14 perform the data write operation, thereby preventing the timing controller 20 from performing a compensation action as soon as the picture data required to be compensated for is detected to cause transient visual changes. On the contrary, if the aggregation value calculated by the operation unit 22 is equal to or larger than the threshold value corresponding to the display panel 10, the operation unit 22 may send a control signal having a stop message. A control signal at a high signal high level is taken as an example. Once the switch 32 obtains the control signal at the high signal level, the common voltage is directly provided to the common electrode 15.

However, the designer needs to perform a test of a reloaded picture on the display panel 10 in advance, so as to find out the aggregation value of the data values when the display panel 10 presents a reloaded picture, and the aggregation value is used as the threshold value in the foregoing description and is set in a storage unit 23 of the timing controller 20 such as a register or a memory. Further, the designer may subtract a tolerance from the aggregation value, so that the obtained threshold value is more precise.

It should be noted that, if the data value is the sub-pixel data, and has 8 bits, for example, in order to reduce an operation amount of the operation unit 22, the designer may design a detection unit 21 for merely detecting the values of the previous bits of the sub-pixel data without exceeding the maximum bit number of the sub-pixel data during data detection, such as the values recorded on the first 2 or 3 bits. Such values may be stored in the storage unit 23 of the timing controller 20, and the recording manner is to store the related data values according to the arrangement sequence of the pixel units 14, such that the operation unit 22 reads the data values to calculate to obtain the foregoing aggregation value.

In addition, in order to reduce the operation amount of the operation unit 22, the designer may enable the detection unit 21 to merely detect the data values of the pixel units 14 in partial successive rows during data detection, for example, only the data values of the pixel units 14 in the previous rows are detected, or only the data values of the pixel units 14 in the next rows are detected. For example, the resolution of the display panel 10 is 1366*768, which means that the pixel points of the display panel 10 are in 768 rows and 1366 rows, and the detection unit 21 merely detects the data values of the pixel units 14 from the first row to the 10th row, or merely detects the data values of the pixel units 14 from the 759th row to the 768th row. Correspondingly, the threshold value corresponding to the display panel may decrease with the reduction of the operation amount.

Figure 2:
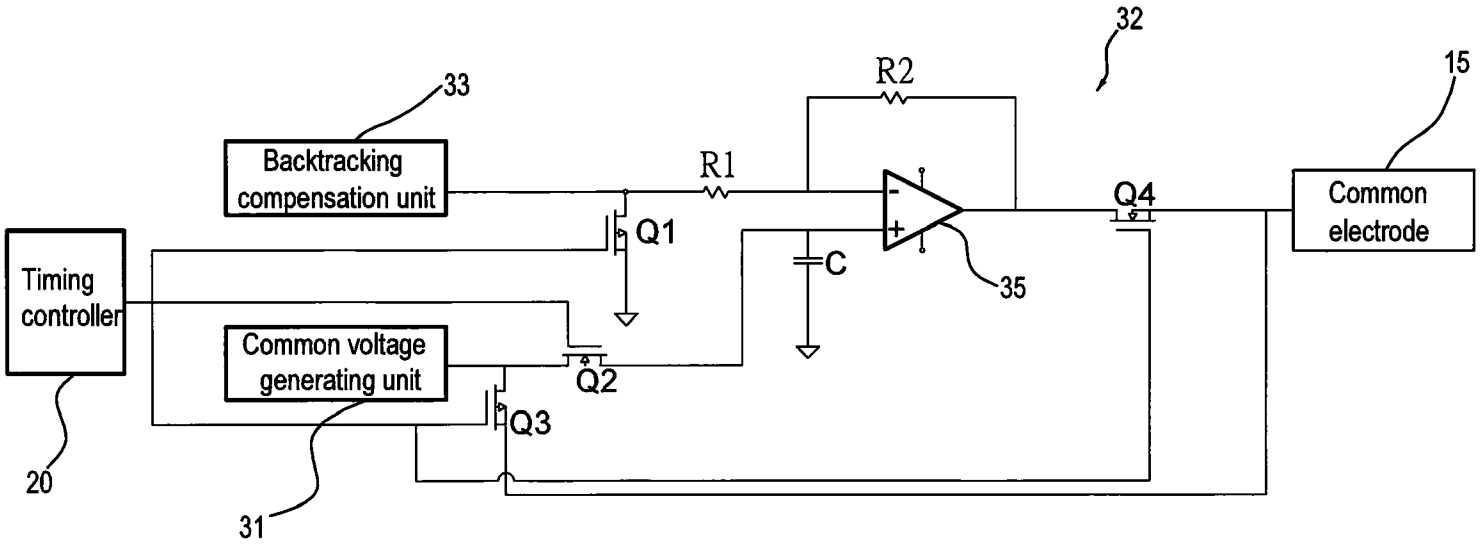
FIG. 2 is a schematic view of a circuit of a voltage generator according to an embodiment of the present invention.

FIG. 2 is a schematic view of a circuit of a voltage generator 30 according to an embodiment of the present invention. Referring to FIG. 2, as described above, the voltage generator 30 includes a common voltage generating unit 31, a backtracking compensation unit 33, and a switch 32. The switch 32 includes a switch circuit and a feedback compensation circuit, in which the feedback compensation circuit includes an operation amplifier 35, two resistors (R1, R2) and a capacitor C, and the switch circuit includes two P-type transistors (Q1, Q3) and two N-type transistors (Q2, Q4), which are electrically connected to the switch circuit. The transistors (Q1, Q2, Q3 and Q4) are all connected to the timing controller 20, so as to obtain a control signal. The voltage generator 30 includes a single output end for being connected to the common electrode 15.

When the aggregation value calculated by the operation unit 22 does not reach the threshold value, the control signal at a low signal level is output to the voltage generator 30.

At this time, the P-type transistor Q1 and the P-type transistor Q3 are powered, while the N-type transistor Q2 and the N-type transistor Q4 are not powered. Therefore, the backtracking voltage and the common voltage are provided to the operation amplifier 35, and then a feedback compensation circuit operates to generate a compensation voltage, and the compensation voltage may be provided to a common electrode 15.

On the contrary, when the aggregation value calculated by the operation unit 22 reaches or exceeds the threshold value, the control signal at a high signal level is output to the voltage generator 30. At this time, the P-type transistor Q1 and the P-type transistor Q3 are powered, while the N-type transistor Q2 and the N-type transistor Q4 are not powered. Therefore, the feedback compensation circuit does not operate, and then the common voltage is directly provided to the common electrode 15.

Figure 3:
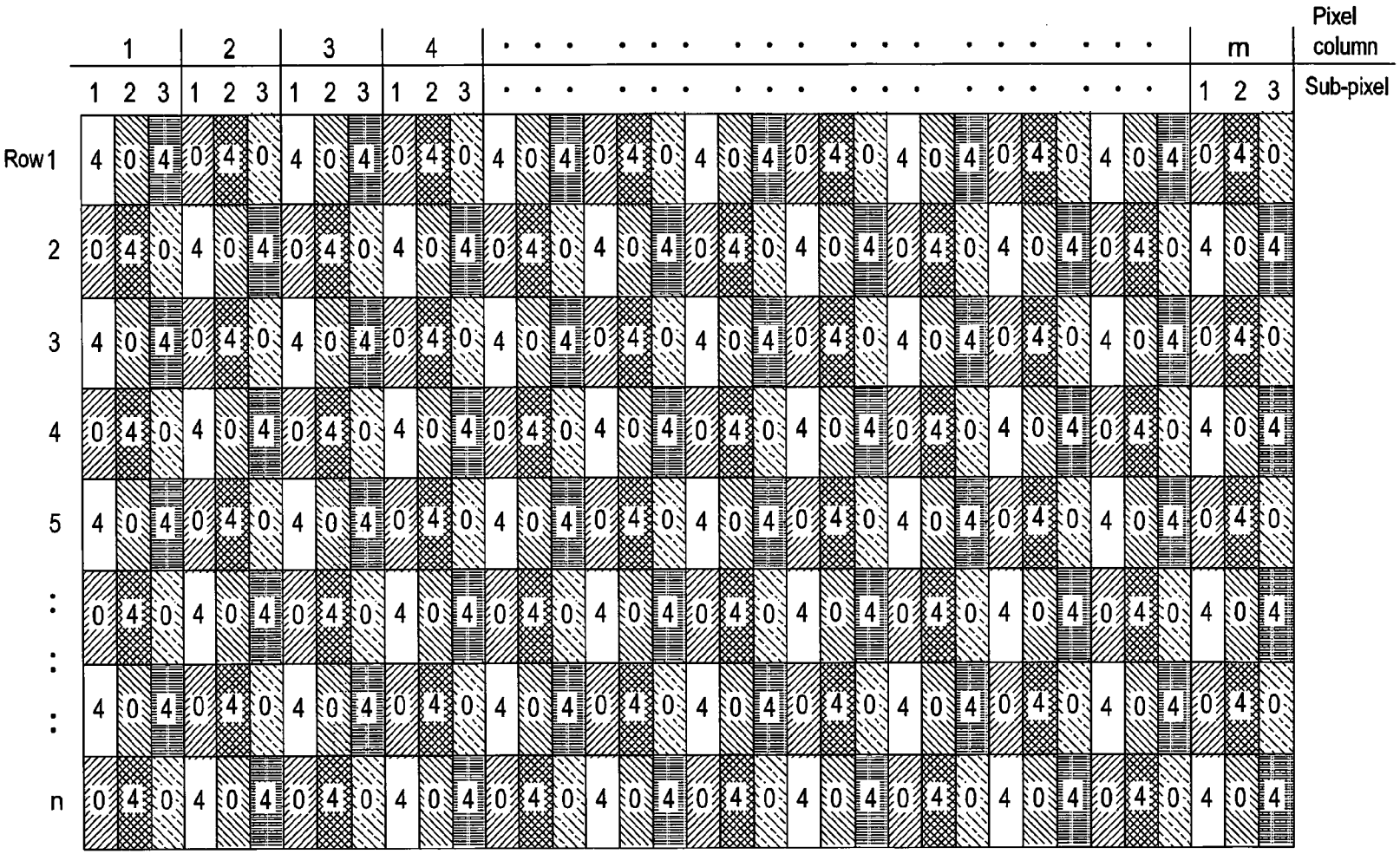
FIG. 3 is a schematic view of a dot pattern according to an embodiment of the present invention.

FIG. 3 is a schematic view of a dot pattern according to an embodiment of the present invention. Referring to FIG. 3 in combination with FIG. 1 for ease of description of an operation mode, the resolution of the display panel 10 here is, for example, 1366*768, but the present invention is not limited thereto. A display picture when the display panel 10 presents a reloaded picture is as shown in FIG. 3. The detection unit 21 may obtain the data values (the sub-pixel data as described before) recorded by the pixel units 14, and the values are recorded in a storage unit 23. The sub-pixel data with 8 bits is taken as an example, and the first two bits of the sub-pixel data are used as the data amount of the sub-pixel, for example, 0 represents 0 grey scale (full off), 2 represents 128 grey scale (middle tone), and 4 represents 256 grey scale (full on).

The operation unit 22 may calculate a difference value between the data values included in the ith pixel unit 14 in the nth row and the ith pixel unit 14 in the (n+1)th row. Alternatively, the operation unit 22 may further calculate a difference value between the data values included in the xth sub-pixel data of the ith pixel unit 14 in the nth row and the xth sub-pixel data of the ith pixel unit 14 in the (n+1)th row.

As shown in FIG. 3, each pixel unit 14 includes three sub-pixel data, the first sub-pixel data corresponds to red, the second sub-pixel data corresponds to green, and the third sub-pixel data corresponds to blue.

The data value of the first sub-pixel data of the first pixel unit in the first row is 4, the data value of the first sub-pixel data of the first pixel unit in the second row is 0, and the difference value between the data values of the two calculated by the operation unit 22 is −4, which is recorded in the storage unit 23.

Further, for example, the data value of the second sub-pixel data of the second pixel unit in the first row is 0, the data value of the second sub-pixel data of the second pixel unit in the second row is 4, and the difference value between the data values of the two calculated by the operation unit 22 is 4, which is recorded in the storage unit 23. In this way, all the required difference values are calculated. Subsequently, the operation unit 22 may obtain absolute values of the difference values, and then aggregate the absolute values to obtain an aggregation value.

It is assumed that, the aggregation value calculated by the operation unit 22 from such data values is $2^2$*1366*3*766=12572664, the aggregation value may be considered as the threshold value of the display panel 10, and is pre-stored in the storage unit 23 of the timing controller 20. However, the operation unit 22 may also obtain the similar or the same aggregation value through other reloaded pictures, and in order to avoid false judgment, a tolerance may be subtracted from the aggregation value, so that the obtained threshold value is more precise, in which the tolerance may be set according to the resolution of the display panel 10.

However, when the timing controller merely detects the data values of the pixel units 14 in partial successive rows, for example, 10 rows, the aggregation value calculated by the operation unit 22 through such data values is 22*1366*3*9=147528. Such aggregation value may be considered as the threshold value of the display panel 10, and is stored in the storage unit 23 of the timing controller 20.

Figure 4:
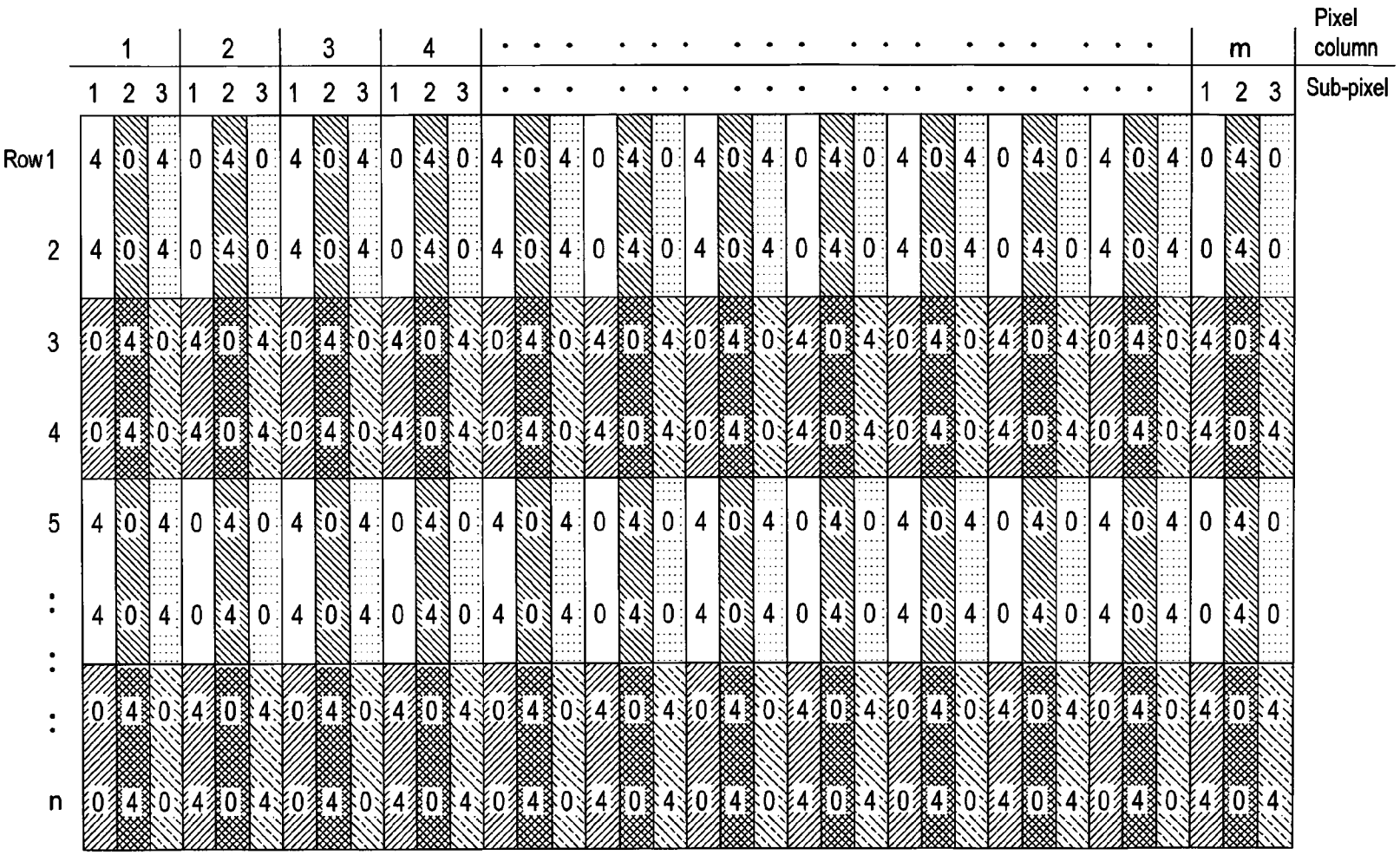
FIG. 4 is a schematic view of a two line pattern according to an embodiment of the present invention.

FIG. 4 is a schematic view of a two line pattern according to an embodiment of the present invention. Referring to FIG. 4 in combination with FIG. 1 for ease of description of an operation mode, and the resolution of the display panel 10 here is, for example, 1366*768, but the present invention is not limited thereto. A display picture when the display panel 10 presents a reloaded picture is as shown in FIG. 4, the detection unit 21 may obtain the data values (the sub-pixel data as described above) recorded by the pixel units 14, and the values are recorded in a storage unit 23. The sub-pixel data with 8 bits is taken as an example, and the first two bits of the sub-pixel data are used as the data amount of the sub-pixels, for example, 0 represents 0 grey scale (full off), 2 represents 128 grey scale (middle tone), and 4 represents 256 grey scale (full on).

The operation unit 22 may calculate a difference value between the data values included in the ith pixel unit in the nth row and the ith pixel unit in the (n+1)th row. Alternatively, the operation unit 22 may further calculate a difference value between the data values included in the xth sub-pixel data of the ith pixel unit in the nth row and the xth sub-pixel data of the ith pixel unit in the (n+1)th row.

Further, for example, the data value of the first sub-pixel data of the first pixel unit in the first row is 4, the data value of the first sub-pixel data of the first pixel unit in the second row is 4, and the difference value between the data values of the two calculated by the operation unit 22 is 0, which is recorded in the storage unit 23.

Further, for example, the data value of the first sub-pixel data of the first pixel unit in the second row is 4, the data value of the first sub-pixel data of the first pixel unit in the third row is 0, and the difference value between the data values of the two calculated by the operation unit 22 is −4, which is recorded in the storage unit 23. In this way, all the required difference values are calculated. Subsequently, the operation unit 22 may obtain absolute values of the difference values, and then aggregates the absolute values to obtain an aggregation value.

It is assumed that the aggregation value calculated by the operation unit 22 from such data values is $2^2$×1366×3×766/2=6286332, and such aggregation value may be considered as the threshold value of the display panel 10, and is stored in the storage unit 23 of the timing controller 20. However, the operation unit 22 may also obtain the similar or the same aggregation value through other reloaded pictures, and in order to avoid false judgment, a tolerance may be subtracted from the aggregation value, that is, [6286332-tolerance], and the tolerance is set according to the resolution of the display panel 10. The threshold value of the two line pattern is smaller than the threshold value of the dot pattern, and therefore the threshold value of the two line pattern may be used as a basis of the judgment.

However, when the timing controller merely detects the data values of the pixel units 14 in partial successive rows, for example, 10 rows, the aggregation value calculated by the operation unit 22 through such data values is 22*1366*3*4=65568. After the tolerance is subtracted from the aggregation value, the obtained value may be considered as the threshold value of the display panel 10, and is pre-stored in the storage unit 23 of the timing controller 20. The threshold value of the two line pattern is smaller than the threshold value of the dot pattern, and therefore the threshold value of the two line pattern may be used as the reference of the judgment.

Figure 5A:
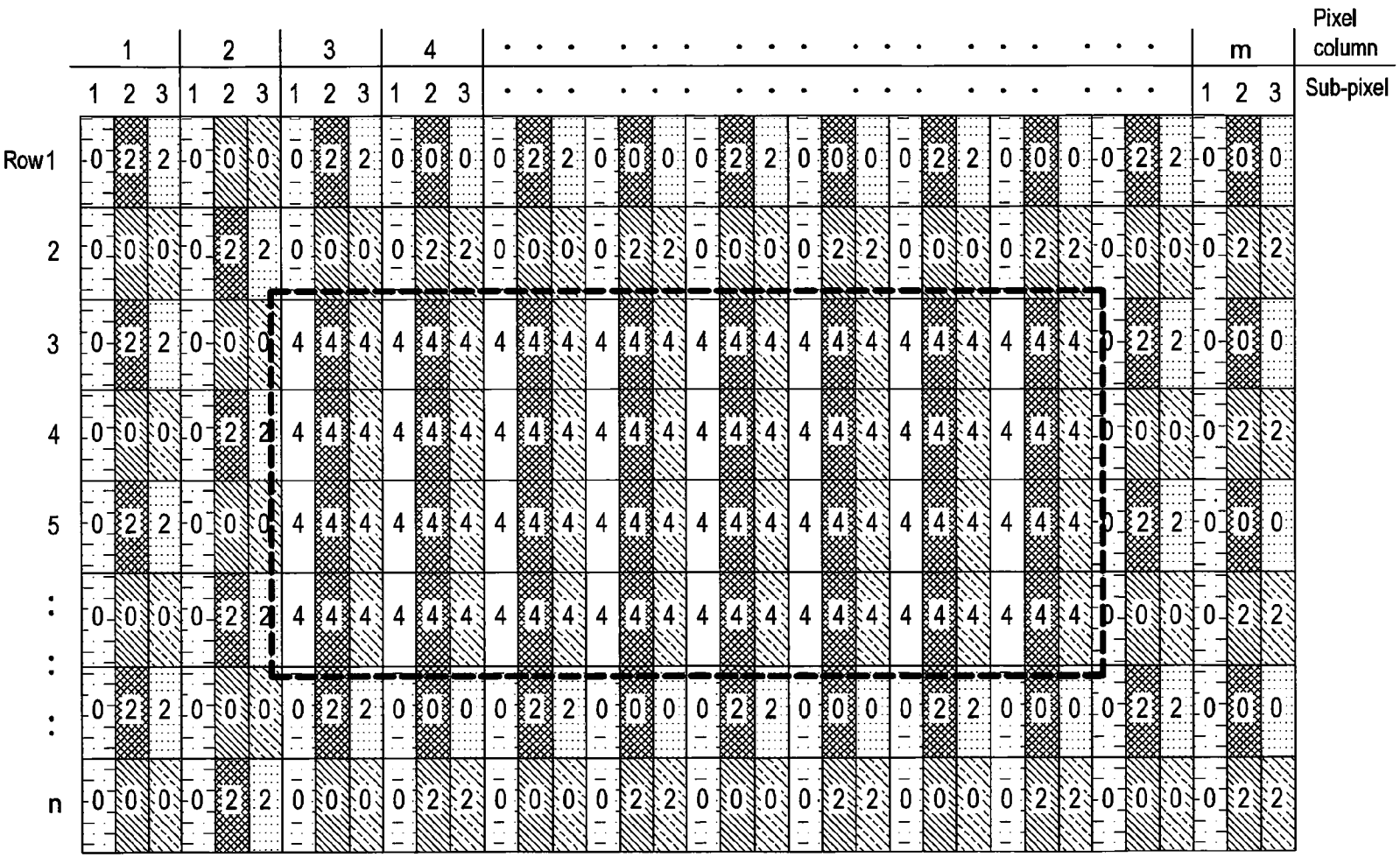
FIG. 5A is a schematic view of picture data corresponding to a horizontal crosstalk according to an embodiment of the present invention.
Figure 5B:
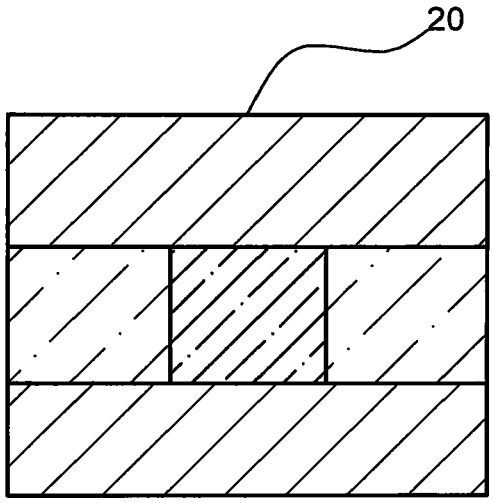
FIG. 5B is a schematic view of a horizontal crosstalk picture according to an embodiment of the present invention.

FIG. 5A is a schematic view of picture data corresponding to a horizontal crosstalk according to an embodiment of the present invention, and FIG. 5B is a schematic view of a horizontal crosstalk picture according to an embodiment of the present invention. Referring to FIG. 5A and FIG. 5B in combination with FIG. 1 and FIG. 4 for ease of description of an operation mode, the resolution of the display panel 10 here is, for example, 1366*768, but the present invention is not limited thereto. In this embodiment, FIG. 5A shows the pixel data of the display panel 10, in which the difference of the pixel data of the regions inside and outside the picture (a dashed block is used as a boundary in this example) is large, and the content of the sub-pixel data of the adjacent pixel units in successive rows is similar. Therefore, the calculated aggregation value is slightly smaller than the threshold value, so that a horizontal crosstalk phenomenon easily occurs, which is as shown in FIG. 5B.

For example, in FIG. 5A, after the detection unit 21 detects the data values recorded by the pixel units 14, the operation unit 22 calculates the aggregation value corresponding to the picture according to the data values. A two line pattern mode is taken as an example here. If the aggregation value calculated by the operation unit 22 is 3152728, since 3152728< [6286332-tolerance], the operation unit 22 may output a control signal having a trigger message to the voltage generator 30, so as to compensate for the common electrode 15.

Figure 6:
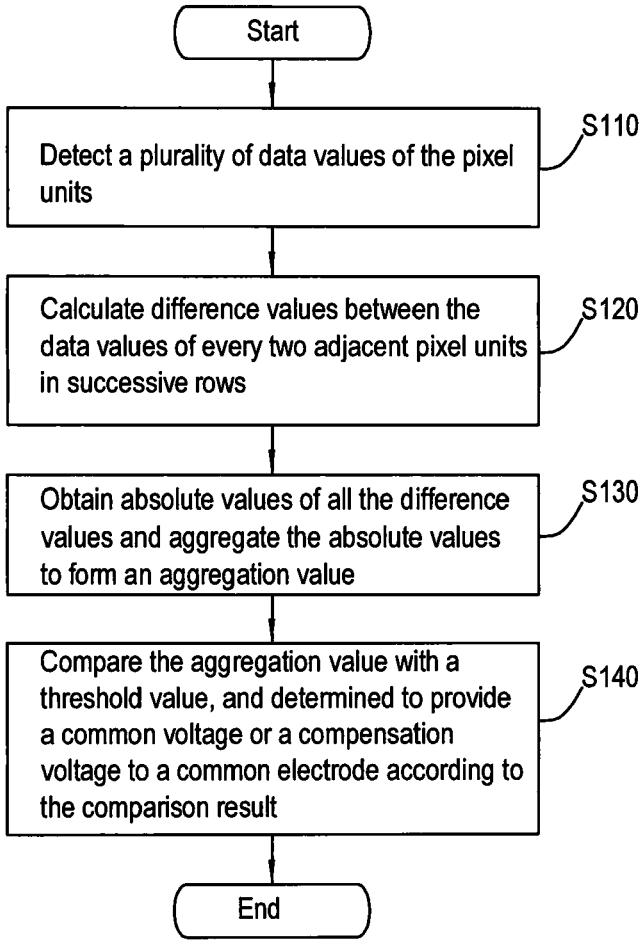
FIG. 6 is a schematic flow chart of a driving method of a display panel according to an embodiment of the present invention.
Figure 7:
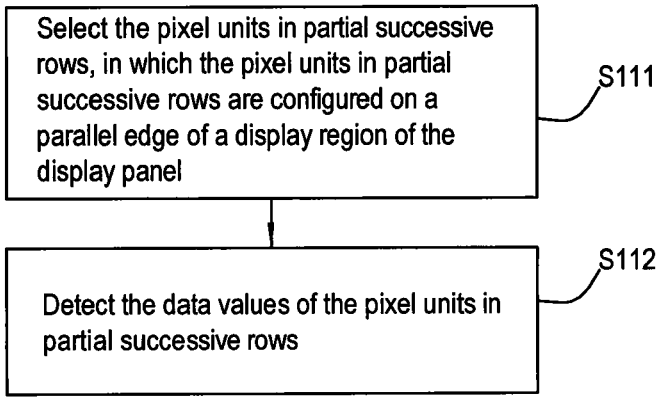
FIG. 7 is a detailed schematic flow chart of the driving method of the display panel according to an embodiment of the present invention.

FIG. 6 is a schematic flow chart of a driving method of a display panel 10 according to an embodiment of the present invention, and FIG. 7 is a detailed schematic flow chart of the driving method of the display panel 10 according to an embodiment of the present invention. Referring to FIG. 6 and FIG. 7 in combination with FIG. 1 for ease of understanding, the process of the driving method is as follows.

A plurality of data values of the pixel units 14 are detected (Step S110). A detection unit 21 may detect the data values stored in the pixel units 14, in which the data value may be pixel data or may further be sub-pixel data. In order to reduce an operation amount of an operation unit 22, the designer may enable the detection unit 21 to merely select the pixel units 14 in partial successive rows during data detection, in which the pixel units 14 are configured on a parallel edge of a display region of the display panel 10 (Step S111). The detection unit 21 may detect the data values of the pixel units 14 in partial successive rows (Step S112), for example, merely detect the data values of the pixel units 14 in previous rows or in next rows.

The difference values between the data values included in every two adjacent pixel units 14 in successive rows are calculated (Step S120). The operation unit 22 may calculate a difference value between the data values included in the ith pixel unit 14 in the nth row and the ith pixel unit 14 in the (n+1)th row, and the data values are the pixel data in the foregoing description. Alternatively, the operation unit 22 may further calculate a difference value between the data values included in the xth pixel unit 14 of the ith pixel unit 14 in the nth row and the xth pixel unit 14 of the ith pixel unit 14 in the (n+1)th row, and the data values are the sub-pixel data in the foregoing description. Subsequently, the operation unit 22 may individually obtain absolute values of all the difference values, and aggregate the absolute values to form an aggregation value (Step S130).

The aggregation value is compared with a threshold value, and it is determined to provide a common voltage or a compensation voltage to a common electrode 15 of the pixel units 14 according to the comparison result (Step S140). The operation unit 22 may compare the aggregation value with the threshold value, and send control signals with different content according to the comparison result. For example, when the aggregation value is smaller than the threshold value corresponding to the display panel 10, the operation unit 22 may send a control signal having a trigger message. If the aggregation value calculated by the operation unit 22 is equal to or larger than the threshold value corresponding to the display panel 10, the operation unit 22 may send a control signal having a stop message.

When a switch 32 obtains the control signal having the trigger message, the switch integrates a common voltage with a backtracking voltage, so as to form a compensation voltage, and transmits the compensation voltage to the common electrode 15. On the contrary, when the switch 32 obtains the control signal having the stop message, the switch directly provides the common voltage to the common electrode 15.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving system of a display panel, wherein the display panel comprises a plurality of pixel units, and the driving system comprises:

a timing controller, connected to the display panel, and comprising a detection unit and an operation unit, wherein the detection unit detects a plurality of data values of the pixel units, and the operation unit calculates difference values between the data values of every two adjacent pixel units in successive rows, obtains an aggregation value of absolute values of the difference values, compares the aggregation value with a threshold value, and outputs a control signal according to a comparison result; and a voltage generator, connected to a common electrode of the display panel and the timing controller, and providing a common voltage or a compensation voltage to the common electrode according to the control signal.

2. The driving system of the display panel according to claim 1, wherein each of the data values of the pixel units is a sub-pixel data.

3. The driving system of the display panel according to claim 1, wherein when the aggregation value is smaller than the threshold value, the operation unit sends the control signal comprising a trigger message, and the voltage generator provides the compensation voltage according to the trigger message; when the aggregation value is equal to or larger than the threshold value, the operation unit sends the control signal comprising a stop message, and the voltage generator provides the common voltage according to the trigger message.

4. The driving system of the display panel according to claim 3, wherein after the operation unit sets a frame, when it is judged that the aggregation value is smaller than the threshold value, the operation unit sends the control signal comprising the trigger message before setting a next frame.

5. The driving system of the display panel according to claim 1, wherein the timing controller further comprises a storage unit for storing the data values in sequence according to an arrangement sequence of the pixel units, and the operation unit reads the data values stored in the storage unit for obtaining the aggregation value through operation.

6. The driving system of the display panel according to claim 1, wherein the detection unit detects the data values comprised in the pixel units in partial successive rows, and the pixel units in partial successive rows are configured on a parallel edge of a display region of the display panel.

7. The driving system of the display panel according to claim 1, wherein the voltage generator comprises a common voltage generating unit for providing the common voltage, a backtracking compensation unit for providing a backtracking voltage, and a switch connected to the timing controller, the common voltage generating unit, the backtracking compensation unit and the common electrode, and providing the common voltage to the common electrode according to the control signal, or integrating the common voltage and the backtracking voltage into the compensation voltage and providing the compensation voltage to the common electrode.

8. A driving method of a display panel, wherein a plurality of pixel units and a common electrode are configured on the display panel, and the method comprises:

detecting a plurality of data values of the pixel units;

calculating difference values between the data values of every two adjacent pixel units in successive rows;

obtaining absolute values of the difference values and aggregating the absolute values to form an aggregation value; and comparing the aggregation value with a threshold value, and determining to provide a common voltage or a compensation voltage to a common electrode of the pixel units according to a comparison result.

9. The driving method of the display panel according to claim 8, wherein when the aggregation value is smaller than the threshold value, the compensation voltage is provided to the common electrode; and when the aggregation value is equal to or larger than the threshold value, the common voltage is provided to the common electrode.

10. The driving method of the display panel according to claim 8, wherein the step of detecting the number of data values of the pixel units further comprises:

selecting the pixel units in partial successive rows, wherein the pixel units in partial successive rows are configured on a parallel edge of a display region of the display panel; and detecting the data values of the pixel units in partial successive rows.

* * * * *